US005797533A

United States Patent [19]

Lee

[11] Patent Number: 5,797,533

[45] Date of Patent: Aug. 25, 1998

[54] STAPLER SAFETY TRIGGER

[76] Inventor: Yun-Chung Lee, 3F No. 117, Yuchoko Tan, Shui Jen Taipei Hsien, Taiwan

[21] Appl. No.: 784,596

[22] Filed: Jan. 21, 1997

[51] Int. Cl.[6] ..... B25C 1/04

[52] U.S. Cl. ..... 227/8

[58] Field of Search ..... 227/8, 130, 120

[56] References Cited

U.S. PATENT DOCUMENTS

| | | | |
|---|---|---|---|
| 4,716,813 | 1/1988 | Prudencio | 227/130 |
| 5,083,694 | 1/1992 | Lemos | 227/130 |
| 5,366,132 | 11/1994 | Simonelli | 227/8 |
| 5,551,621 | 9/1996 | Vallee | 227/130 |
| 5,669,541 | 9/1997 | Ronconi | 227/8 |

*Primary Examiner*—Scott A. Smith
*Attorney, Agent, or Firm*—Pro-Techtor International Services

[57] ABSTRACT

The present invention relates to a safety trigger for a stapler, comprising: a switch for ejecting the nails being operated by pressing thereon from below; a trigger, mounted below the switch on the stapler, its front end having a hinge, where the trigger is mounted; a safety-catch, rotatably mounted on the trigger, operating in an enabled state and a disabled state, having a first projection extending outward for operating the switch, the first projection pointing to the switch in the enabled state and pointing beside the switch in the disabled state, the safety-catch further having a second projection extending towards the front end of the trigger; a first spring for moving the safety-catch into the enabled state; a second spring for moving the safety-catch into the disabled state; and a glide bar, vertically movable mounted on the stapler, the glide bar, when the stapler is set on an object, being pushed upward, contracting the second spring and allowing the first spring to move the safety-catch into the enabled state, and the glide bar, when the stapler is removed from the object, being pushed down by the second spring and moving the safety-catch into the disabled state.

5 Claims, 5 Drawing Sheets

STAPLER SAFETY TRIGGER

BACKGROUND OF THE INVENTION

1. Field of the Invention

The present invention relates to a safety trigger for a stapler, particularly to a safety trigger, which triggers the ejection of nails only after the stapler has been set on a work object.

2. Description of Related Art

Currently used ejection systems for staplers are provided with a safety device, in order to protect workers and other persons from inadvertent ejecting of nails. Such a safety device has a safety-catch with two states for enabling and disabling the ejection of nails. These states are controlled by a glide bar. Setting the stapler on the work object pushes up the glide bar, enabling the safety-catch to operate a switch for ejecting nails. The switch is operated by manually pulling a trigger. When the stapler is not set on an object, the safety-catch is disabled, and the ejection of nails is blocked. The safety system, however, does not block the ejection of nails, when the user inadvertently first pulls the trigger and then presses the stapler against an object. Since users often keep their finger close to the trigger even when removing the stapler from the working object, there is a great risk of injuries for the user or other persons.

SUMMARY OF THE INVENTION

The object of the present invention is to provide a safety trigger for a stapler, which allows for safer operation.

The present invention can be more fully understood by reference to the following description and accompanying drawings.

DETAILED DESCRIPTION OF THE PREFERRED EMBODIMENTS

As shown in all Figs., the safety trigger of the present invention is mounted on a stapler having a lower tip, from where nails are ejected. It allows for ejection, when the lower tip of the stapler is set on a work object. The safety trigger of the present invention comprises a trigger 10, a safety-catch 20, attached to the trigger 10, a glide bar 30, which is connected to the front tip of the stapler and controls the safety-catch 20, and a switch 70 for ejecting nails.

Figure 1:
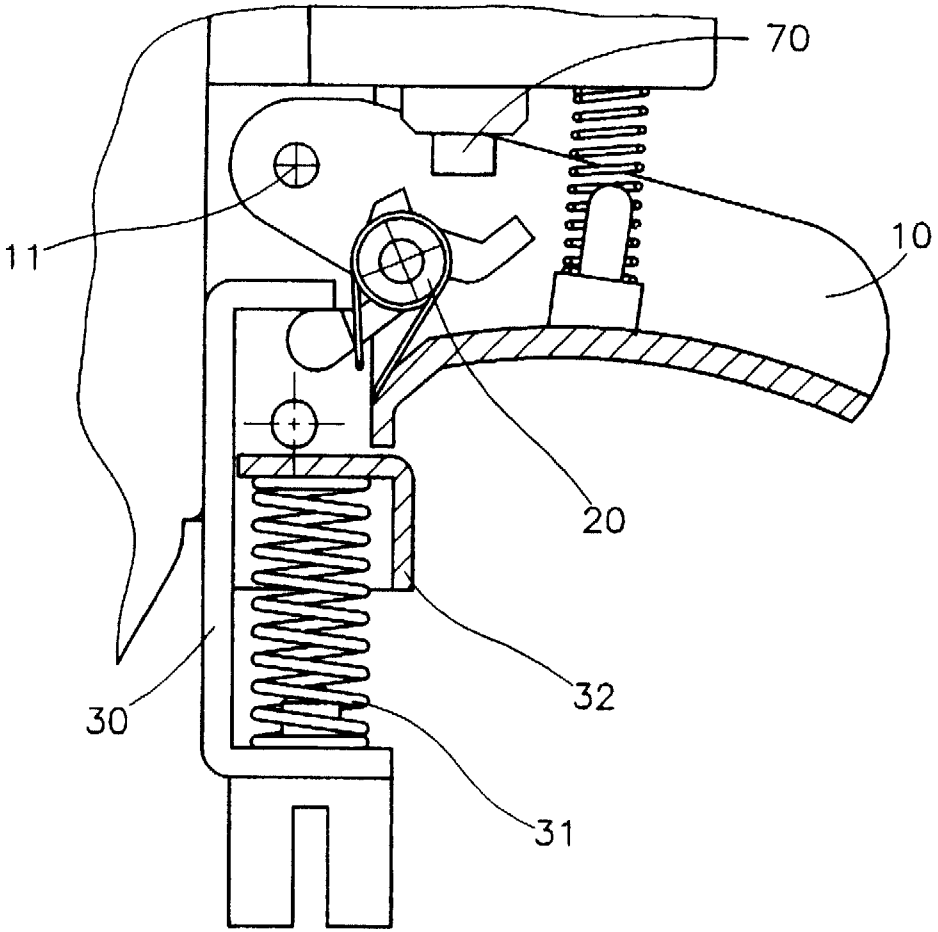
FIG. 1 is a schematic illustration of the safety trigger for a stapler of the present invention, showing the assembly of the structural parts thereof.

Referring to FIG. 1, the trigger 10 is roughly shaped like the letter U. It is placed below the switch 70 at a certain distance therefrom. The front end of the trigger 10 has a hinge 11, where the trigger 10 is mounted on the stapler. The trigger 10 is thus movable upward until close to the switch 70.

Figure 2A:
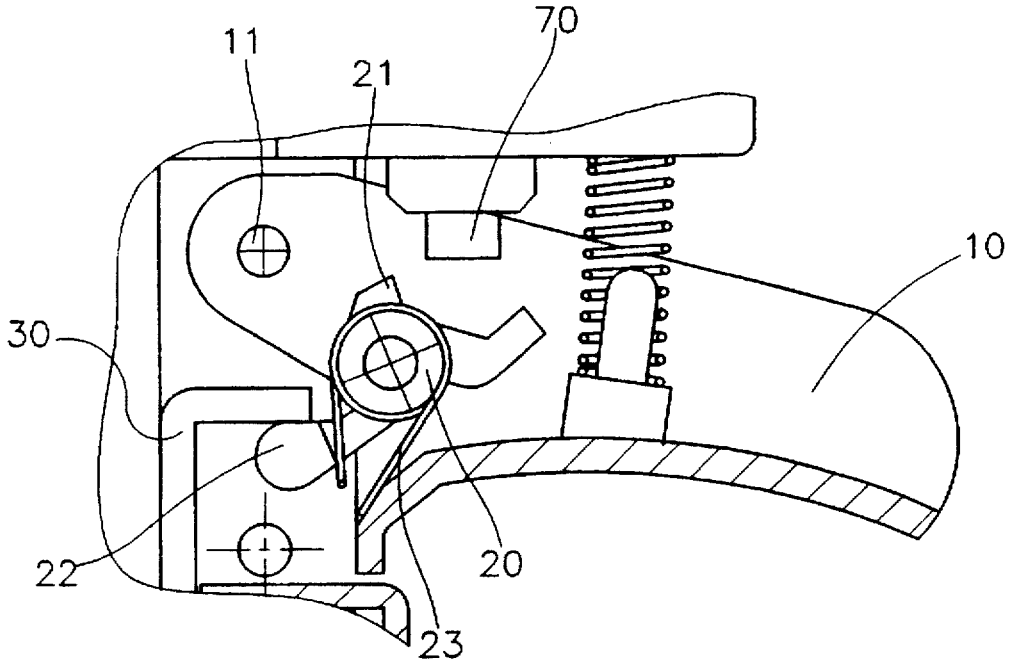
FIG. 2 is a schematic illustration of the switching system of the present invention.
Figure 2B:
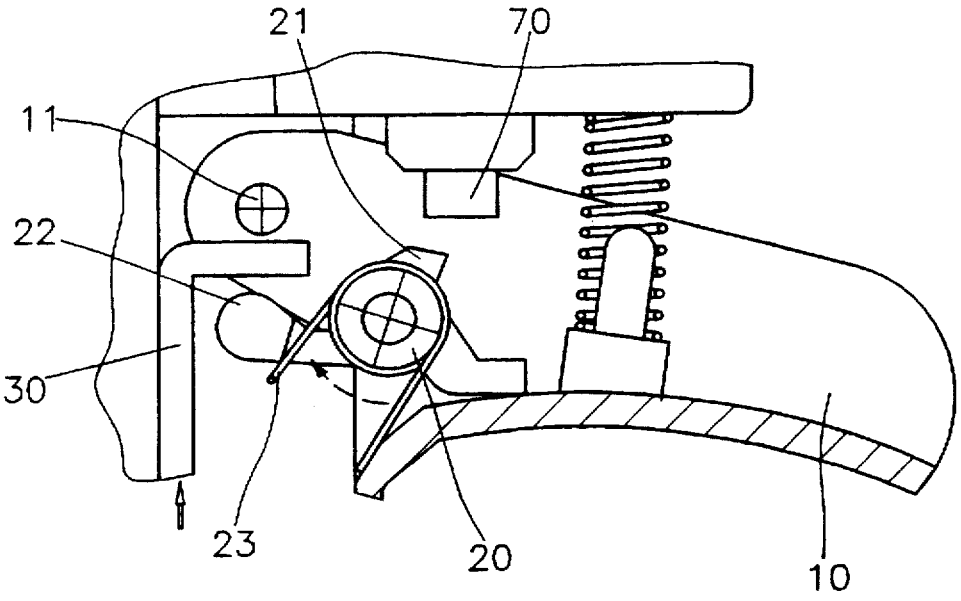

As shown in FIG. 2, the safety-catch 20 is rotatably mounted on the trigger 10. The rotational axis of the safety-catch 20 is positioned lower than the hinge 11. The safety-catch 20 operates at two angular positions. It has a perimeter, from which a first projection 21 extends outwards. At the first angular position of the safety-catch 20 the first projection 21 points to the switch 70, at the second angular position it points aside. When the trigger 10 is pulled upward, the safety-catch 20 moves closer to the switch 70. Then, at the first angular position of the safety-catch 20, defining an enabled state thereof, the first projection 21 touches the switch 70 from below, thus operating it. However, at the second angular position of the safety-catch 20, defining a disabled state thereof, the first projection 21 moves beside the switch 70.

From the perimeter of the safety-catch 20 a second projection 22 extends towards the front end of the trigger 10. Furthermore, a first spring 23 is put on the perimeter of the safety-catch 20. The elastic force of the first spring 23 tends to turn the the safety-catch 20 into the first angular position, into the enabled state.

Figure 3C:
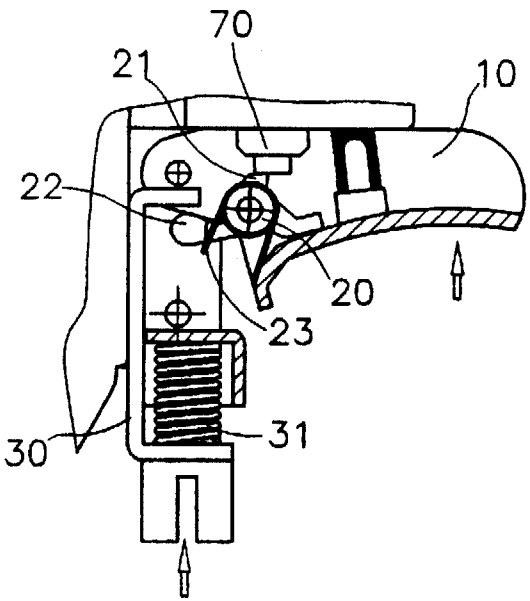
FIG. 3 is a schematic illustration of the movement of the present invention, when the stapler is set on an object and the trigger is pressed.
Figure 3B:
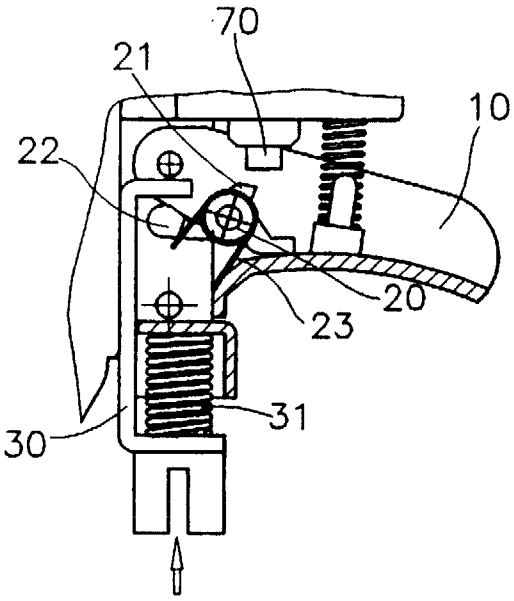
Figure 3A:
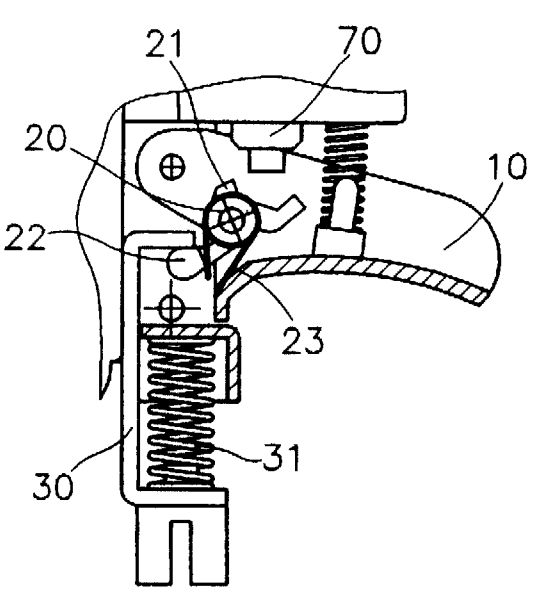

As shown in FIGS. 1, 2 and 3, the glide bar 30 is shaped like a wide sideway letter U with an upper and a lower end. The upper end of the glide bar 30 is close to the front end of the trigger 10, above the second projection 22 of the safety-catch 20. The glide bar 30 is vertically movable within the stapler. When the glide bar 30 is moved down, it takes the second projection 22 of the safety-catch 20 along, causing the safety-catch 20 to turn away from the first angular position. Therefore, when the glide bar 30 is in a low position, the safety-catch 20 is in the disabled state. In this state, the safety-catch 20 will not touch the switch 70, after pulling up the trigger 10. When the stapler is set on a work object, the glide bar 30 is pushed upward, releasing the second projection 22 of the safety-catch 20 and allowing the safety-catch 20 to turn into the enabled switch. In this state, pulling the trigger 10 operates the switch 70.

Between the lower end of the glide bar 30 and a fixed element 32 a second spring 31 is inserted. The fixed element 32 is attached to the stapler. The second spring 31 presses down the glide bar 30. The elastic force of the second spring 31 exceeds that of the first spring 23. Therefore, when no external force presses on the lower end of the stapler, the glide bar 30 is in the lower position, and the safety-catch 20 is in the disabled state. Only pressing on the lower end of the stapler will push the glide bar 30 into the upper position, allowing the safety-catch 20 to turn into the enabled state.

Figure 4C:
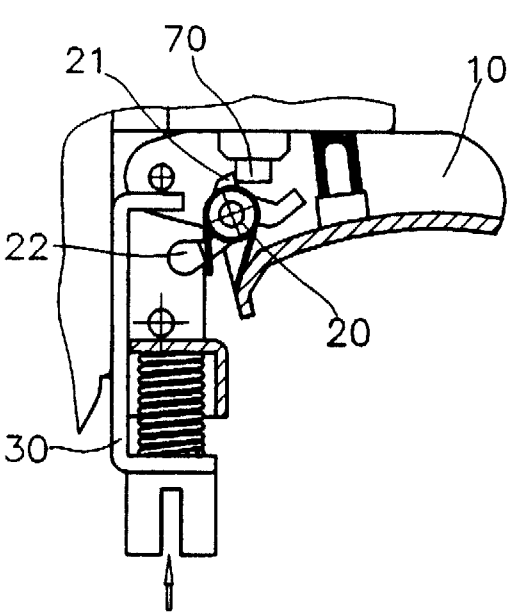
FIG. 4 is a schematic illustration of the movement of the present invention, when the trigger is released first and then the stapler is set on an object.
Figure 4B:
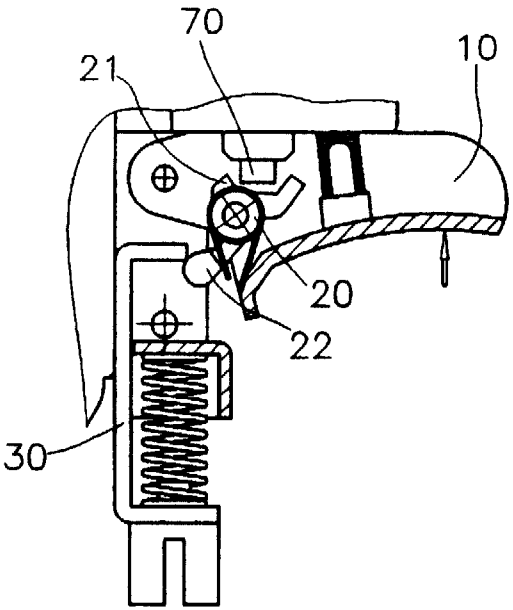
Figure 4A:
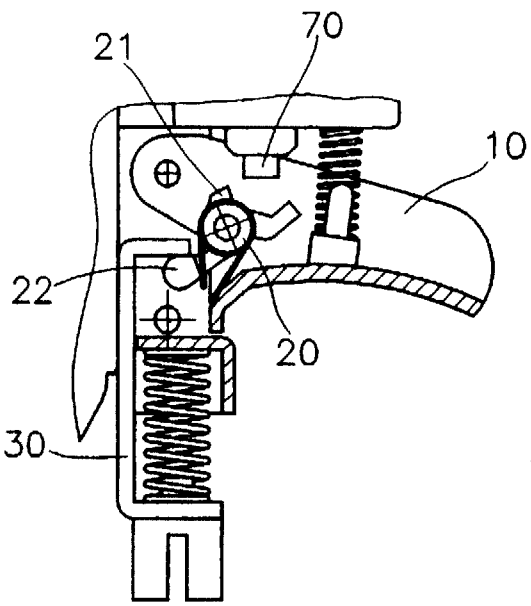

The angular position of the safety-catch 20 is controlled by the vertical position of the glide bar 30. Therefore, pulling the trigger 10, while the glide bar 30 is in the lower position causes the first projection 21 to move beside the switch 70, leaning against it. As shown in FIG. 4, when in this state the glide bar 30 moves up, the angular position of the safety-catch does not change, because the first projection 21 is blocked by the switch 70. So first pulling the trigger 10 and the setting the stapler on an object will not cause nails to be ejected, thus enhancing the protection against inadvertent ejection of nails.

Figure 5B:
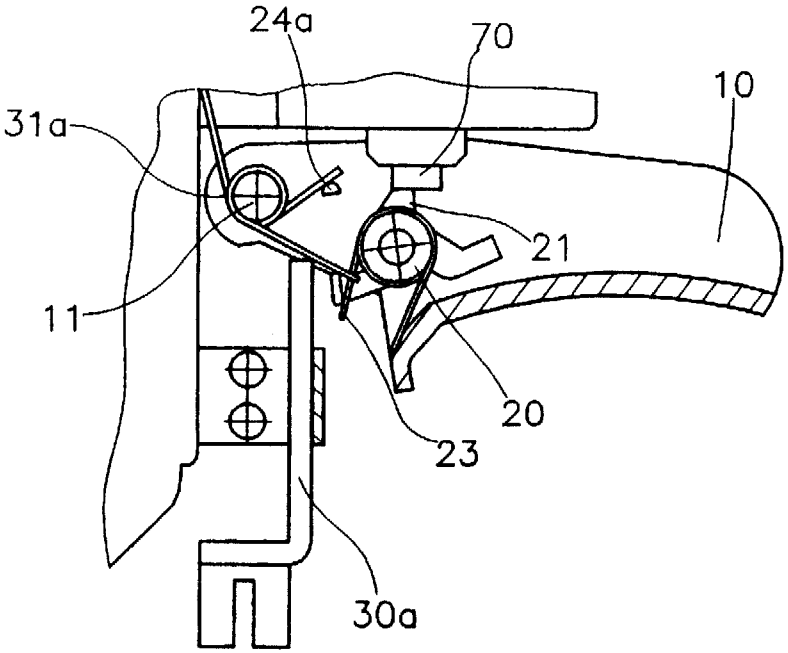
FIG. 5 is a schematic illustration of the safety trigger for a stapler of the present invention in a second embodiment.
Figure 5A:
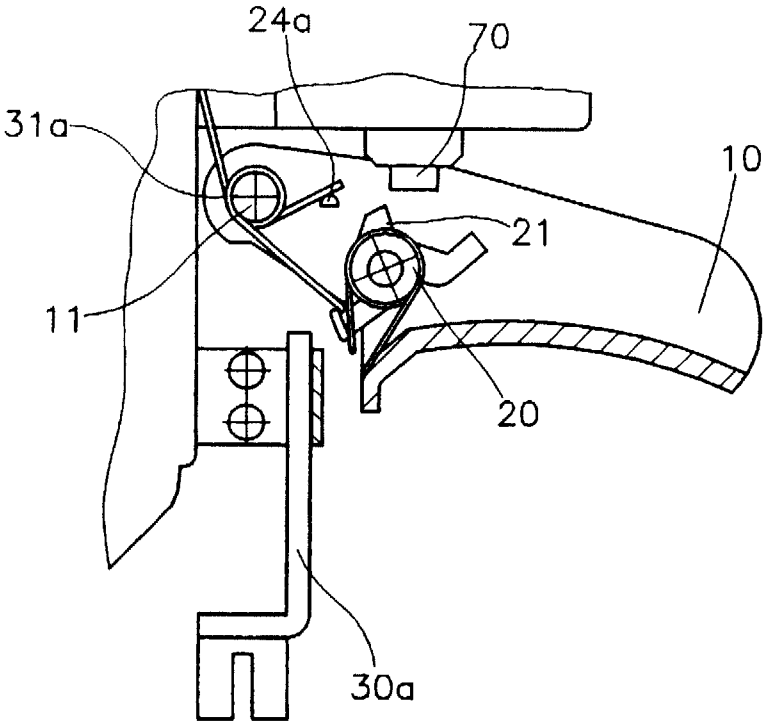

Referring to FIG. 5, the safety trigger of the present invention in a second embodiment has a second spring 31*a*, substituted for the second spring 31. The second spring 31*a* is put around the hinge 11 and directly presses on the second projection 22, causing the safety-catch to turn into the second angular position. The second spring 31*a* also presses down on a support 24*a*, which is attached to the trigger 10, keeping the trigger 10 in a lower position, when not pulled.

The second embodiment of the present invention further has a glide bar 30*a*, vertically gliding within the stapler, its upper end being close to the safety-catch. When the stapler is set on an object, the glide bar 30*a* is pushed upward, pressing against the second spring 31*a* and releasing the second projection 22, such that the safety-catch 20 moves into the enabled state.

What is claimed is:

1. A safety trigger for a stapler with a lower end, from where nails are ejected into a work object, said safety trigger comprising:

a switch for ejecting said nails, mounted on said stapler, said switch being operated by pressing thereon from below;

a trigger, mounted below said switch on said stapler, shaped like the letter U, having a front end and a back end, said front end having a hinge, where said trigger is mounted, such that said back end of said trigger is movable upward, closer to said switch, and downward, away from said switch;

a safety-catch, rotatably mounted on said trigger, operating in an enabled state and a disabled state, said safety-catch having a first projection extending outward for operating said switch, said first projection pointing to said switch in said enabled state and pointing beside said switch in said disabled state, said safety-catch further having a second projection extending towards said front end of said trigger;

a first spring for moving said safety-catch into said enabled state;

a second spring for moving said safety-catch into said disabled state; and a glide bar, vertically movable mounted on said stapler, said glide bar, when said stapler is set on an object, being pushed upward, contracting said second spring and allowing said first spring to move said safety-catch into said enabled state, and said glide bar, when said stapler is removed from said object, being pushed down by said second spring and moving said safety-catch into said disabled state;

wherein in said enabled state of said safety catch, moving said trigger upwards presses said first projection on said switch, thus operating said switch, and in said disabled state of said safety catch, moving said trigger upwards moves said first projection beside said switch, without operating said switch, and wherein after first moving said trigger upward in said disabled state, then pushing up said glide bar, said first projection stays beside said switch, preventing said safety-catch to turn into said enabled state, such that said switch is not operated.

2. A safety trigger for a stapler according to claim 1, wherein by turning said safety-catch, said first projection points to said switch, thus being enabled to operate said switch.

3. A safety trigger for a stapler according to claim 1, wherein by turning said safety-catch, said first projection points beside said switch.

4. A safety trigger for a stapler according to claim 1, wherein said safety-catch has a rotational axis, which is located below said hinge.

5. A safety trigger for a stapler according to claim 1, wherein said second spring has a larger elastic force than said first spring.

* * * * *